US006988461B1

(12) United States Patent
James

(10) Patent No.: US 6,988,461 B1
(45) Date of Patent: Jan. 24, 2006

(54) TELESCOPING BOAT TOWER APPARATUS

(76) Inventor: Joseph B. James, P.O. Box 372, Terra Ceia, FL (US) 34250

( * ) Notice: Subject to any disclaimer, the term of this patent is extended or adjusted under 35 U.S.C. 154(b) by 0 days.

(21) Appl. No.: 11/107,040

(22) Filed: Apr. 15, 2005

(51) Int. Cl.
*B63B 17/00* (2006.01)

(52) U.S. Cl. ..... 114/364

(58) Field of Classification Search ..... 114/343, 114/361, 364; 135/88.01; 52/111, 121; 182/69.4, 182/118

See application file for complete search history.

(56) References Cited

U.S. PATENT DOCUMENTS 2,576,389 A * 11/1951 Craighead et al. ..... 52/121
3,000,473 A * 9/1961 Reynolds ..... 52/121
3,724,595 A * 4/1973 Green ..... 182/118
5,918,613 A 7/1999 Larson
6,244,205 B1 * 6/2001 Saccocio ..... 114/343
6,349,666 B1 2/2002 Hastings
6,550,414 B1 4/2003 Correll et al.
6,584,926 B1 7/2003 Schmitt et al.
6,666,163 B2 12/2003 Pastor et al.
6,860,222 B2 * 3/2005 Himmel ..... 114/361

* cited by examiner

*Primary Examiner*—Lars A. Olson
(74) *Attorney, Agent, or Firm*—Charles J. Prescott

(57) ABSTRACT

A telescoping boat tower apparatus attachable atop a deck structure of a boat. The apparatus includes lower and upper frame assemblies each including spaced upright tubular supports, the lower frame assembly supports attachable at a lower end thereof to the deck. The tubular supports of the upper assembly are connected at an upper end to a standing platform positioned above a console of the boat. The upper frame assembly includes spaced upright elongated second tubular supports, which are connected at an upper end thereof to a body support rail and held in telescoping coaxial alignment and registry with corresponding first tubular members whereby the upper frame assembly is slidably movable vertically with respect to the lower frame assembly. An elongated sealed interior chamber defined between at least one pair of corresponding first and second tubular supports is connected to a source of pressurized fluid introducible into the chamber whereby the upper frame assembly is vertically movable with respect to the lower frame assembly.

16 Claims, 7 Drawing Sheets

TELESCOPING BOAT TOWER APPARATUS

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to boat tops, and particularly to a vertically telescopic boat tower which may be lowered sufficiently to negotiate the boat beneath low bridges and other low hanging obstructions which might otherwise preclude boat movement there beneath.

2. Description of Related Art

Smaller boats and particularly those characterized as being open center console-type boats will typically include a shade and weather top such as a Bimini top or T-top which is attached to deck or center console over the center console. This top structure increases the overall height of the boat thus creating a potential clearance problem which might prevent the boat from traveling beneath low lying overhead trees, wires or low bridges.

A number of prior art devices are taught which at least partially address this issue by temporarily reducing the height clearance of the boat equipped with such top structure as follows:

U.S. Pat. No. 6,666,163 to Pastor, et al.

U.S. Pat. No. 6,584,926 to Schmitt, et al.

U.S. Pat. No. 6,349,666 to Hastings

U.S. Pat. No. 6,550,414 to Correll, et al.

U.S. Pat. No. 5,918,613 to Larson

The '163 patent to Pastor, et al. teaches an adjustable boat top that can be lowered to permit the boat to travel under bridges and other obstructions. A T-top apparatus with built-in seat for boats is taught by Schmitt, et al. in the '926 patent and Hastings discloses an articulated boat top assembly in U.S. Pat. No. 6,349,666.

Correll, et al. discloses a boat accessory rack in which the supports are adjustable in length in the '414 patent and Larson discloses a detachable tee-top for boat center consoles in U.S. Pat. No. 5,918,613.

In addition to sun and weather tops as above described attachable to these small center-console boats, some are also equipped with what are referred to as a "boat tower" or "tuna" or "fishing tower" which provide an elevated station for piloting the boat at a pilot height substantially above that achievable when standing on the deck of the boat. These boat towers are particularly popular because of the greatly extended visibility to horizon when in a standing position atop the standing platform positioned above the center console, which platform also serves as the sun and weather shade when operating the boat at the center console thereof.

However, these boat towers with a second, elevated helm station usually associated therewith which allows the operation of the boat from either the lower center console station or from the boat tower control station elevated thereabove, even more drastically increase the height clearance requirement of such equipped boats. It is therefore almost a requirement that these boat tower structures be somehow reduced in height so that the lower bridges and overhanging waterway structure may be negotiated thereunder. The most popular means for accomplishing the temporary reduction of clearance height of these boat towers is simply to provide a pivotal arrangement whereby the entire tower be pivotable forwardly into a downwardly stored position to allow a boat to negotiate low bridge clearances and passageway beneath low hanging structure or trees.

The present invention provides an improved alternative to the above by providing a vertically telescopically collapsible boat tower which, by the utilization of pressurized fluid, preferably pressurized air, facilitates the downward telescopic movement of the upper tower assembly into a temporary position which is substantially lowered to facilitate low overhead clearance passageway.

BRIEF SUMMARY OF THE INVENTION

This invention is directed to a telescoping boat tower apparatus attachable atop a deck structure of a boat. The apparatus includes lower and upper frame assemblies each including spaced upright tubular supports, the lower frame assembly supports attachable at a lower end thereof to the deck. The tubular supports of the upper assembly are connected at an upper end to a standing platform positioned above a console of the boat. The upper frame assembly includes spaced upright elongated second tubular supports which are connected at an upper end thereof to a body support rail and held in telescoping coaxial alignment and registry with corresponding first tubular members whereby the upper frame assembly is slidably movable vertically with respect to the lower frame assembly. An elongated sealed interior chamber defined between each pair of corresponding first and second tubular supports is connected to a source of pressurized fluid introducible into each chamber whereby the upper frame assembly is vertically movable with respect to the lower frame assembly.

It is therefore an object of this invention to provide a convenient means for temporarily reducing the height clearance of a center console-type boat equipped with the elevated boat tower apparatus.

Still another object of this invention is to provide a telescoping boat tower and a second station control associated therewith for a center console-type boat, which is conveniently reducible in overall height clearance for negotiating beneath lower clearance bridges and overhanging tree structures.

Yet another object of this invention is to utilize a pressure fluid actuated mechanism for the lowering and raising of a vertically telescoping boat tower apparatus with upper station boat control features which facilitates reducing the height clearance of the boat tower when traveling beneath low clearance bridges and the like.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
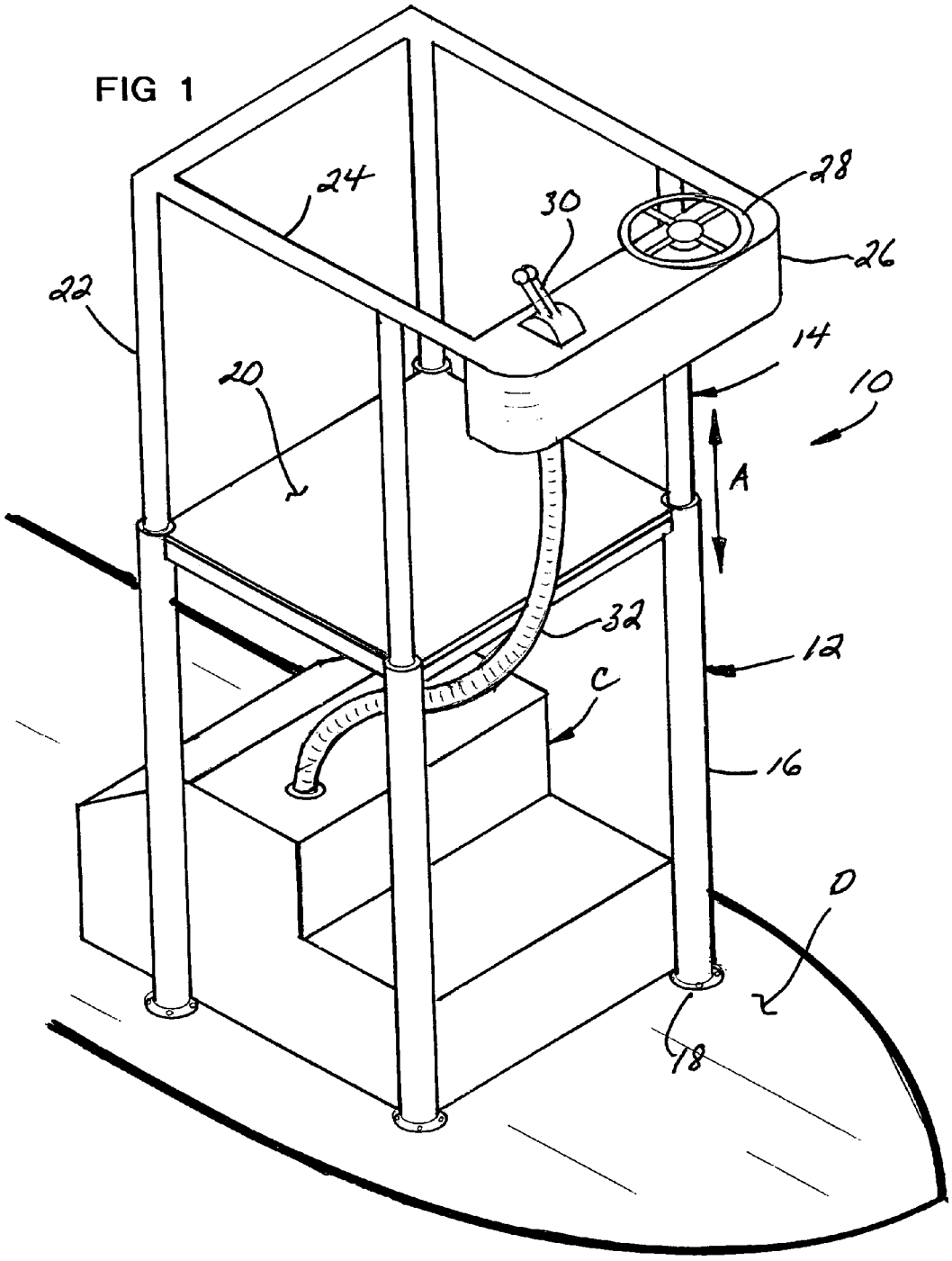
FIG. 1 is a perspective view of the invention connected atop a deck of a convention center console-type boat.
Figure 2:
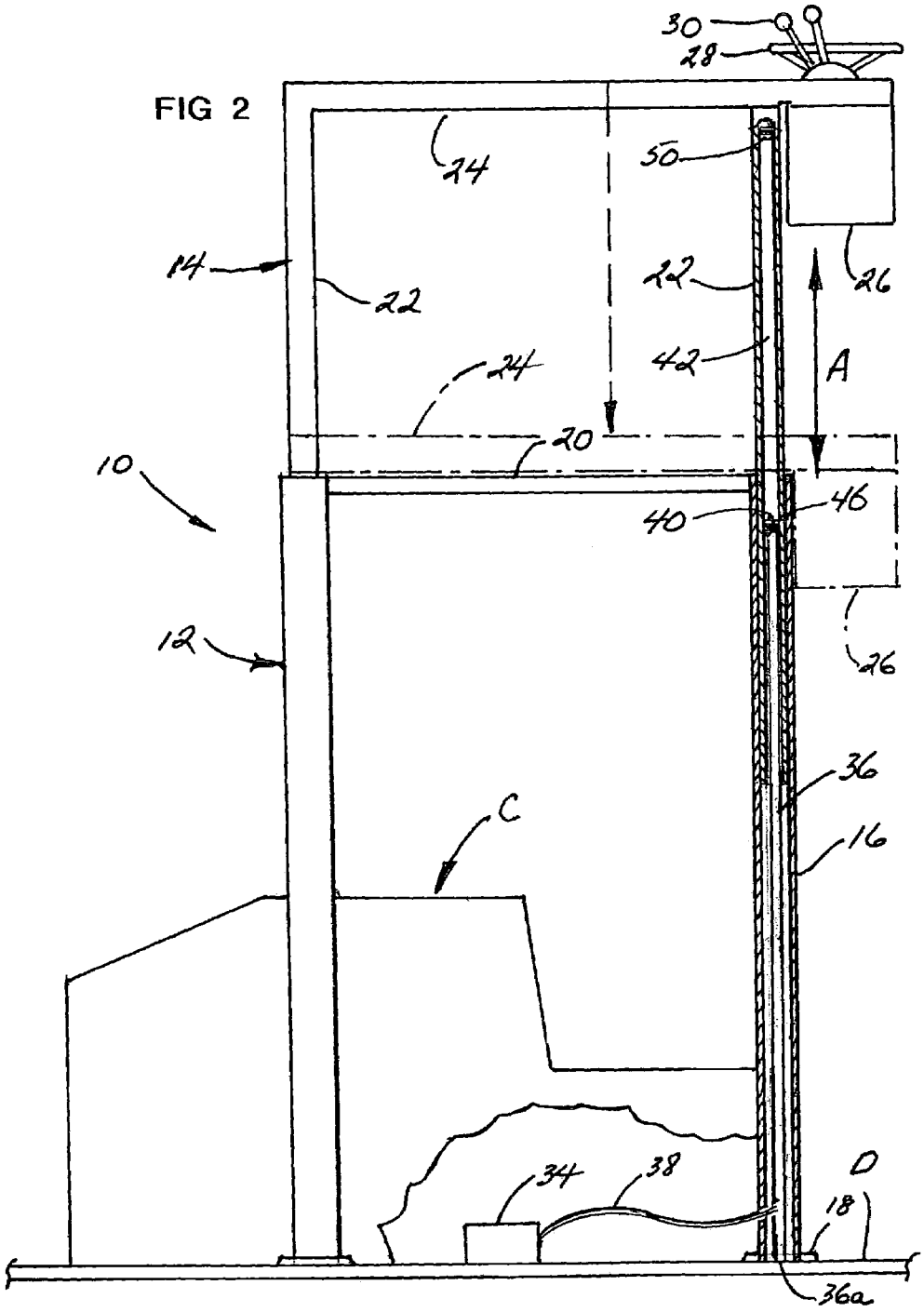
FIG. 2 is a side elevation partial section view of FIG. 1.
Figure 3:
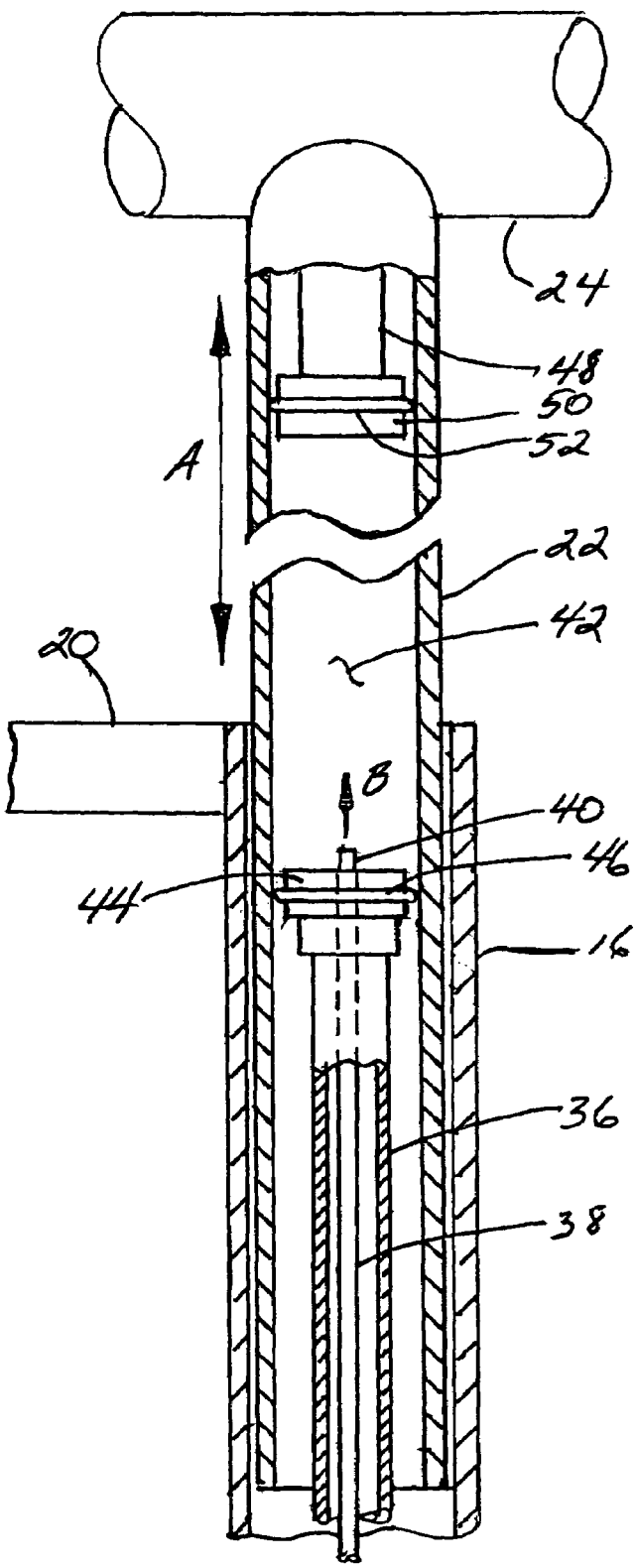
FIG. 3 is an enlarged partial section view of a portion of FIG. 2.

Referring now to the drawings, and particularly to FIGS. 1 to 3, one embodiment of the invention is there shown generally at numeral 10 and in the form of a telescoping boat tower apparatus attachable atop a deck structure D of a center console-type boat. The apparatus 10 includes a lower frame assembly shown generally at numeral 12, and an upper frame assembly 14 which is telescopically movable up and down in the direction of arrow A with respect to the lower frame assembly 12 as best seen in FIG. 2.

The lower frame assembly 12 includes a plurality of four spaced upright first tubular supports shown generally at 16 (preferably 2" diameter schedule 40 aluminum pipe) which are attached to the deck structure D by attaching collars 18. The first tubular supports 16 are secured in spaced parallel, generally upright orientation as shown to a rigid standing platform 20 formed of tubular frame of rigid panel material or woven fabric structure. Additional bracing structure between the and each of the upright first tubular supports 16 is typically added but has been eliminated for clarity in the drawings.

The upper frame assembly 14 includes a plurality of four spaced upright elongated second tubular supports shown typically at 22 (preferably 1.5" diameter schedule 40 aluminum pipe) each of which are connected by weldment at the upper end portions thereof to a body support rail 24. Typically, the upper frame assembly 14 further includes an upper helm including a throttle gearshift control mechanism 30 and a steering mechanism 28, the control transmitting cables therefor housed within a flexible tubular conduit 32 extending down to the center console shown typically at letter C. Note that the center console C will also include a lower helm (not shown for clarity).

Each of the second tubular supports 22 are aligned parallel one to another and coaxial with the corresponding first tubular supports 16 to form pairs 16/22 such that the upper frame assembly 14 will move up and down in the direction of arrow A smoothly and without substantial binding between the first and second tubular supports 16 and 22.

As best seen in FIG. 3, the upper end of each of the second tubular supports is sealed from substantial fluid leakage by an O-ring seal 52 held in position on a sealing plug 50 which is in turn supported by an axial shaft 48 attached to a corresponding segment of the body support rail shown typically at 24.

The first and second tubular supports 16 and 22 preferably have a respective length of 80" and 74" and are overlapping such that movement upwardly in the direction of arrow A will maintain an overlapping sufficient engagement therebetween (e.g. about 36") as best seen in FIGS. 2 and 3, so as to maintain strength and stability therebetween.

An elongated inner tubular member 36 (1" dia.) is positioned within one and preferably two of the second tubular members 22 and extends upwardly from and receives vertical support abutted against the deck D upwardly to in proximity to the upper end of each of the first tubular members 16. Attached to the upper end of this inner tubular member 36 is a sealing member 44 which includes an O-ring seal 46 sealingly engaged against the interior wall surface of the second tubular support 22.

Positioned within and extending substantially coextensively with the inner tubular member 36 is a fluid conduit 38 which is connected at a lower end thereof to a fluid pump 34 positioned within the center console C as seen in FIG. 2. Again, the preferred fluid driving mechanism is air; however, fresh or seawater may be utilized in conjunction with a suitable pump arrangement as an alternative power means to accomplish the telescoping features of the present invention.

The upper end of each of the fluid conduits 38 is connected to an exit port 40 of the sealing member 44 so that pressurized fluid discharges into a sealed chamber 42 in the direction of arrow B. This sealed chamber 42 is preferably defined within the second tubular member 22 between the sealing members 44 and 50. Thus, by introducing pressurized fluid into this sealed chamber 42 in the direction of arrow B, the entire upper frame assembly 14 is moved upwardly to the in-use position shown in FIGS. 1 and 2 in solid line. To lower the height of the upper frame assembly 14, the pressurized fluid is released by pump 34 allowing the weight of gravity to allow the upper frame assembly 14 to move downwardly into the position shown in phantom in FIG. 2.

By this preferred arrangement, a relatively small sealed chamber 42 is more rapidly fillable with compressed fluid, preferably air to facilitate the raising and lowering of the upper frame assembly 14 while the weight-bearing function of the inner tubular member 36 distributes the entire weight of the upper frame assembly 14 directly to the deck during periods when the latching mechanism (described herebelow) is disengaged during the telescopic movement.

Note that, because of the large lifting force produced within each of the sealed chambers, only one or two of the chambers needs to be pressurized although pressurization of all four chambers will avoid binding and insure uniform lifting of each of the second tubes 22.

Figure 4:
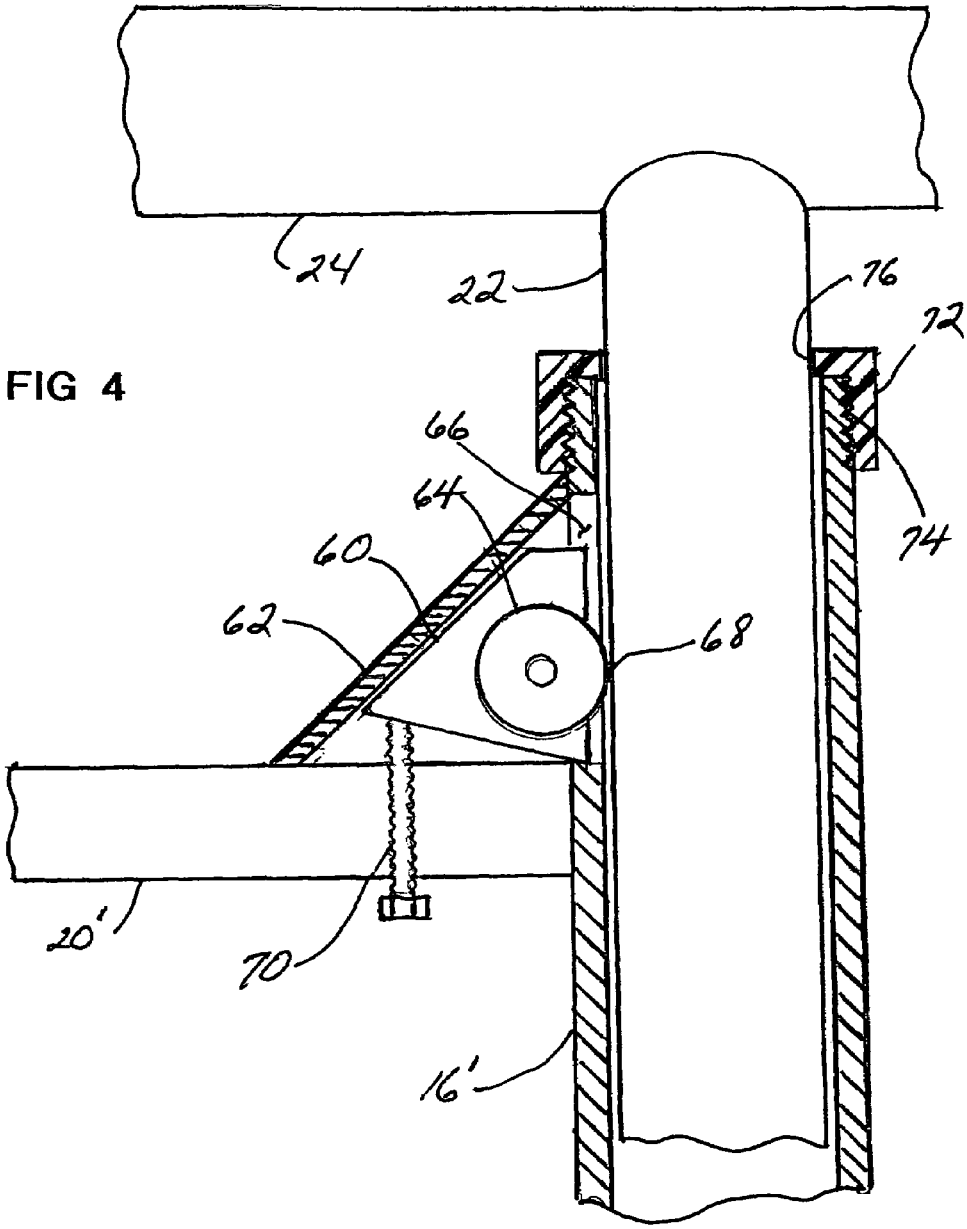
FIG. 4 is a view similar to FIG. 3 depicting a roller centering mechanism and a guide member.

Referring now to FIG. 4, to help insure smooth non-binding telescopic movement of the upper frame assembly 14 with respect to the lower frame assembly 12, maintaining a centered position of each of the second tubular supports 22 within each of the corresponding first tubular supports 16' is preferred. To accomplish this, two alternative means are shown in FIG. 4, the first being a plastic alignment cap or guide 72 which is threadably engaged onto male threads 74 formed on the upper end of each of the first tubular support members 16'. A central aperture 76 formed into the centering cap 72 is provided so as to maintain a centered optimal clearance arrangement between the tubular supports 22 and 16' as shown.

Alternately, a centering roller 64 mounted for rotation on a moveable plate 60 is positioned within a longitudinal slot 66 formed into the side wall of each of the first tubular members 16'. The support plate 60 is held in position by an outer securement plate 62 and is made pivotable by a threaded adjusting screw 70 threadably engaged as shown within the side margin of the standing platform 20'. By this arrangement, suitable adjustment of the adjusting member 20 causes the adjusting roller 64 to exert a centering force at 68 between the tubular support members 16' and 22 to facilitate optimal frictionless telescopic movement therebetween. Moreover, for aesthetics, such towers may lean rearwardly, in which case, the features in FIG. 4 become more essential to relieve any binding.

Figure 5:
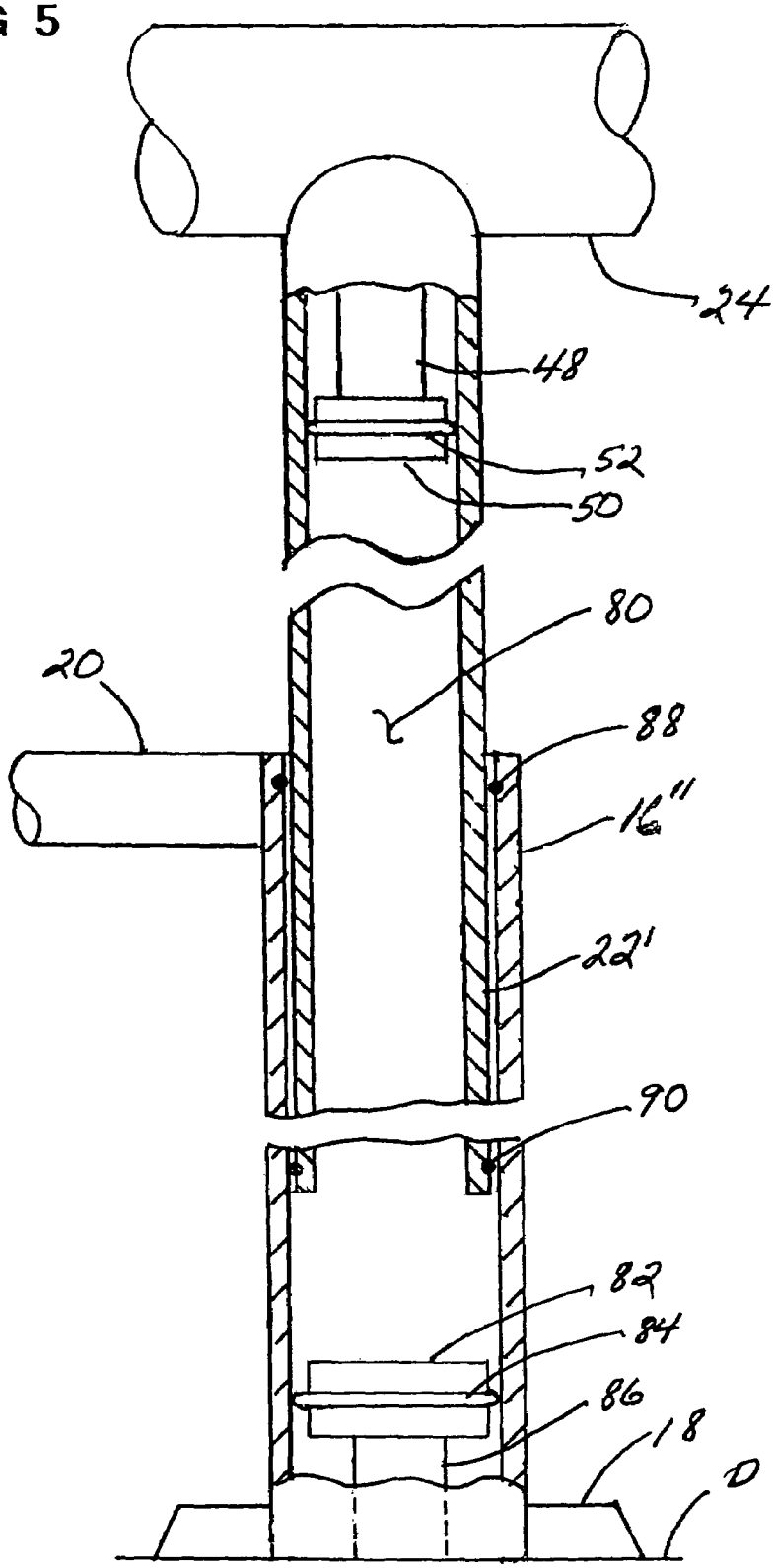
FIG. 5 is a view similar to FIG. 3 showing an alternate embodiment of the invention.

Referring now to FIG. 5, an alternate embodiment of one aspect of the invention is there shown which includes modified lower tubular members 16" which are structured and connected to the deck D as previously described. Each of the second tubular supports 22' are structured substantially as previously described and connected to the body support rail 24 except as described herebelow. In this embodiment of the invention, the sealed fluid chamber 80 extends longitudinally of the interior of the first tubular support 16" from the lower sealing member 82 which includes an O-ring seal 84 acting upon and sealing against the inner surface of each of the corresponding first tubular members 16" to the sealing member 50 at upper end of the second tubular support 22' which is sealed as previously described.

To seal and help reduce friction and improved alignment between the overlapping telescoping support members 16' and 22', sealing O-rings at 88 and 90 are provided and positioned within inner and outer grooves formed into and immediately adjacent the ends of the tubular supports 16" and 22' as shown. Thus, the sealed chamber 80, being somewhat substantially longer in size, requires additional compressed air to activate the up and down telescopic movement of the upper frame assembly as a trade-off to reduced system complexity and cost by the elimination of the inner tubular member 36 previously described in FIGS. 1 to 3.

Figure 6:
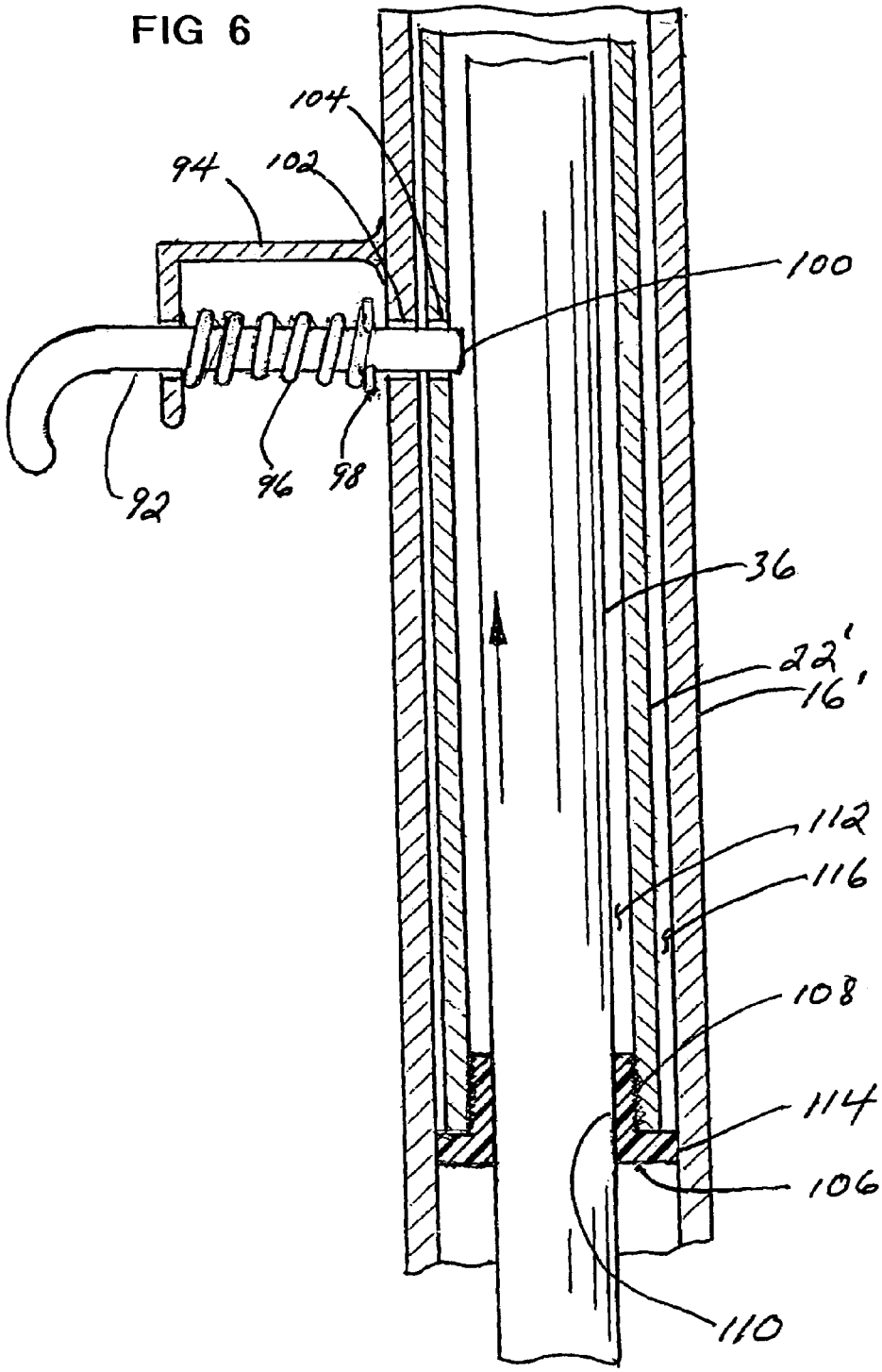
FIG. 6 is a section view showing a preferred self-height locking mechanism of the invention.

Referring lastly to FIG. 6, a preferred mechanism for locking the upward in-use position of the upper frame assembly 16 with respect to the lower frame assembly 12 is there shown. This locking mechanism is in the form of a spring-loaded locking pin 92 held for axial movement in bracket 94 are which interengages between mating apertures 102 and 104 formed into each corresponding pairs of first and second supports 16' and 22'. From the temporarily lowered position of the upper frame assembly 14, each of the second tubular supports 22' move upwardly in the direction of the arrow. The distal end 100 of the spring loaded locking pin 92 is maintained biasingly pressed by spring 96 against cotter pin 98 and against the outer surface of the second tubular supports 22' until the locking aperture 104 comes into alignment and registry therewith at which time the locking pin 92 automatically snaps into engagement into aperture 104. Thereafter, the height alignment is thus maintained holding the upper frame assembly 14 in the upper in-use position.

An alternate and preferred alignment guide 106, machined of plastic material such as Nylon, DELRIN or other suitable plastic material of relatively low frictional characteristics is shown threadably engaged at threads 108 into a mating female thread formed into the lower end of each of the second support members 16'. The center alignment aperture 110 slidably engages over the outer surface of the previously described inner tubular member 36 to maintain a uniform annular gap 112 with respect to the inner surface of each of the second tubular supports 16'. Flange 114 is closely aligned against the inner surface of the first tubular member 16' so as to center both the second tubular member 22' and the inner tubular member 36 to maintain the uniform coaxially aligned relationship shown in this FIG. 6.

Figure 7:
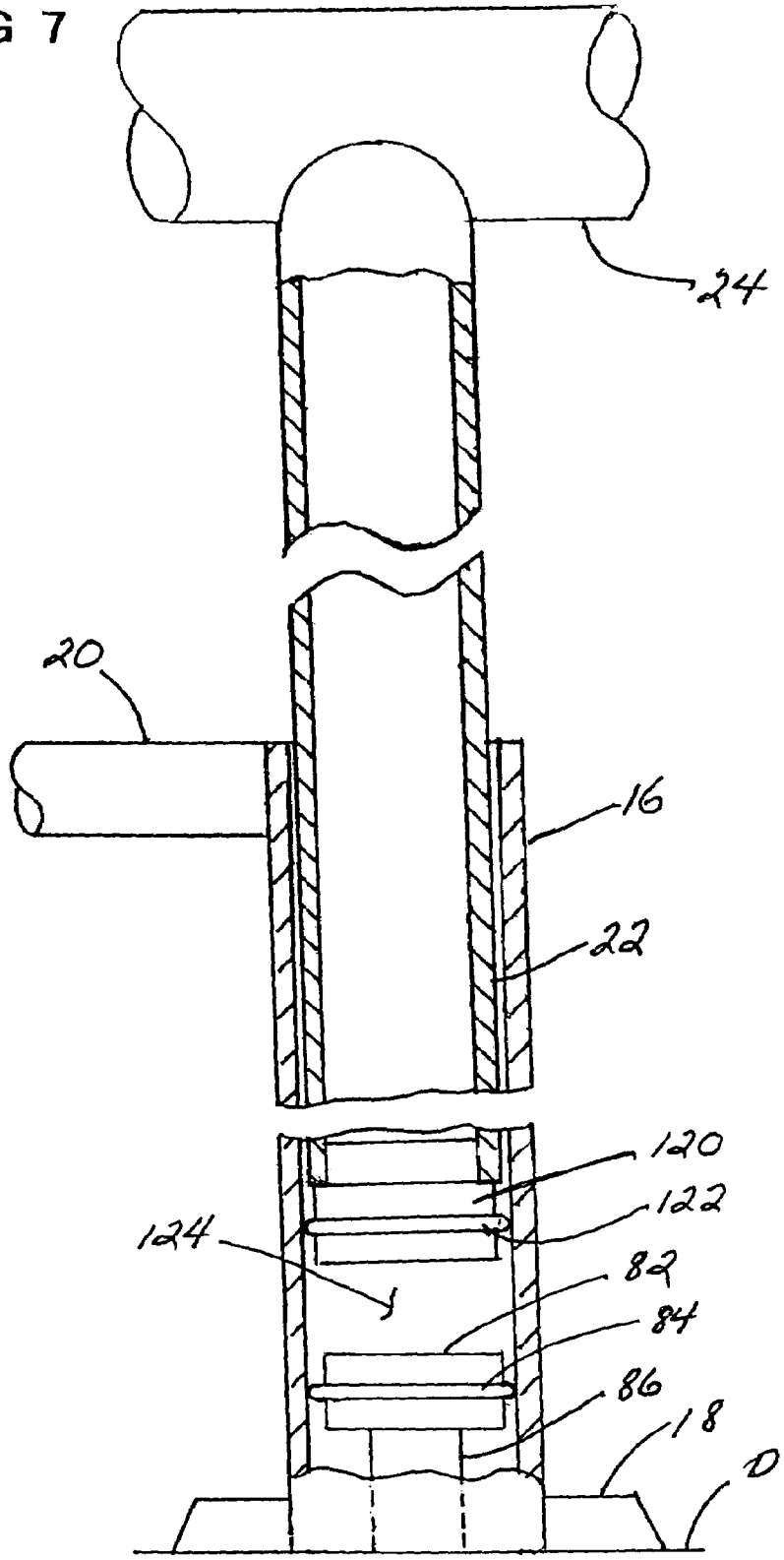
FIG. 7 is a view similar to FIG. 5 showing yet another alternative embodiment of the invention.

Referring now to FIG. 7, still another alternate embodiment of one aspect of the invention is there shown and includes all of the corresponding similarly numbered elements previously described except with respect to the size and placement of the sealed fluid chamber 124. This chamber 124 is formed between the lower sealing member 82 and its O-ring seal 84 acting upon and sealing against the inner surface of the first tubular member 16 and the sealing member 120 secured at the lower end of the second tubular support 22. The sealing member 120 also includes an O-ring seal 122 which is sealably engageable against the inner surface of the first tubular member 16. By this arrangement, the chamber 124 is quite small and will thus respond quickly to pressurized fluid being introduced there into by one of the means described hereinabove.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A telescoping boat tower apparatus attachable atop a deck structure of a boat comprising:

a lower frame assembly including a plurality of spaced generally upright elongated first tubular supports each attachable at a lower end thereof to the deck of a boat, an upper portion of each of said first tubular supports being connected to a perimeter of and including a standing platform positioned above a console and deck of the boat;

an upper frame assembly including said plurality of spaced upright elongated second tubular supports each connected at an upper end thereof to a body support rail and held in overlapping telescoping coaxial alignment and registry with corresponding said first tubular members whereby said upper frame assembly is movable vertically with respect to said lower frame assembly by telescopic movement between said plurality of first and second tubular supports;

an elongated sealed interior volume defined between at least one pair of corresponding said first and second tubular supports;

a source of pressurized fluid introducible into said sealed interior chamber whereby said upper frame assembly is vertically movable with respect to said lower frame assembly responsive to controlled variation of the fluid pressure and volume of fluid in said sealed interior chamber between a lowered temporary position and an elevated in-use position of said upper frame assembly.

2. A telescoping boat tower apparatus as set forth in claim 1, further comprising:

centering guide members positioned between corresponding said first and second tubular members for reduced friction and smooth telescoping movement between said first and second tubular members.

3. A telescoping boat tower apparatus as set forth in claim 1, further comprising:

a centering roller adjustably positioned between an upper portion of each of said first tubular members and corresponding said second tubular members for centering said second tubular member with respect to said first tubular member for reduced friction and smooth telescoping movement between said first and second tubular members.

4. A telescoping boat tower apparatus as set forth in claim 1, further comprising:

a combination travel limit and height lock plunger positioned between corresponding first and second tubular members whereby said upper frame assembly is prevented from excessive upward movement above a pre-determined upper in-use position thereto.

5. A telescoping boat tower apparatus attachable atop a deck structure of an open center console-type boat comprising:

a lower frame assembly including a plurality of spaced generally upright elongated substantially parallel first tubular supports each attachable at a lower end thereof to the deck of a boat and having an open at an upper end thereof, an upper portion of each of said first tubular supports being connected to a perimeter portion of a standing platform positioned above a center console and deck of the boat;

an upper frame assembly including the plurality of spaced generally upright elongated substantially parallel second tubular supports each connected at an upper end portion thereof to a body support rail, each of said second tubular supports aligned coaxially in telescoping overlapping relation to a corresponding one of said first tubular members whereby said upper frame assembly is movable vertically with respect to said lower frame assembly by telescopic movement between said plurality of first and second tubular supports;

an elongated sealed interior volume defined by at least one pair of corresponding said first and second tubular supports;

a source of pressurized fluid introducible into said sealed interior chamber whereby said upper frame assembly is vertically movable with respect to said lower frame assembly responsive to controlled variation of the fluid pressure and volume of fluid in said sealed interior chamber between a lowered temporary position and an elevated in-use position of said upper frame assembly.

6. A telescoping boat tower apparatus as set forth in claim 5, further comprising:

centering guide members positioned between corresponding said first and second tubular members for reduced friction and smooth telescoping movement between said first and second tubular members.

7. A telescoping boat tower apparatus as set forth in claim 5, further comprising:

a centering roller adjustably positioned between an upper portion of each of said first tubular members and corresponding said second tubular members for centering said second tubular member with respect to said first tubular member for reduced friction and smooth telescoping movement between said first and second tubular members.

8. A telescoping boat tower apparatus as set forth in claim 5, further comprising:

a combination travel limit and height lock plunger positioned between corresponding first and second tubular members whereby said upper frame assembly is prevented from excessive upward movement above a pre-determined upper in-use position thereto.

9. A telescoping boat tower apparatus attachable atop a deck structure of an open center console-type boat comprising:

a lower frame assembly including a plurality of spaced upright elongated substantially parallel first tubular supports each attachable at a lower end thereof to the deck of a boat and having open at an upper end thereof, an upper portion of each of said first tubular supports being connected to a perimeter portion of a generally horizontal standing platform positioned above a center console and deck of the boat;

an upper frame assembly including the plurality of spaced upright elongated substantially parallel second tubular supports each connected at an upper end portion thereof to a body support rail, each of said second tubular supports sealed at an upper end portion thereof and aligned coaxially in telescoping overlapping coaxial alignment and registry with a corresponding one of said first tubular members whereby said upper frame assembly is movable vertically with respect to said lower frame assembly by telescopic movement between said first and second tubular supports;

an elongated inner tubular member positioned within and substantially coextensive with a portion of each of said first tubular supports, each of said inner members receiving support from the deck and including a sealing member connected at an upper end thereof in sealing engagement within an inner wall surface of the corresponding said second tubular support;

an elongated sealed interior volume defined within at least one of said second tubular members and extending between said sealed upper end portion and said sealing member;

a source of pressurized fluid;

a fluid conduit in fluid communication at one end thereof with said source of pressurized fluid and extending within a substantial portion of the lengths of each of said inner tubular members and terminating at a fluid port formed through said sealing member whereby pressurized fluid is introducible into said sealed interior chambers whereby said upper frame assembly is vertically movable with respect to said lower frame assembly responsive to controlled variation of the fluid pressure and volume of fluid in said sealed interior chambers between a lowered temporary position and an elevated in-use position of said upper frame assembly.

10. A telescoping boat tower apparatus as set forth in claim 9, further comprising:

centering guide members positioned between corresponding said first and second tubular members for reduced friction and smooth telescoping movement between said first and second tubular members.

11. A telescoping boat tower apparatus as set forth in claim 9, further comprising:

a centering roller adjustably positioned between an upper portion of each of said first tubular members and corresponding said second tubular members for centering said second tubular member with respect to said first tubular member for reduced friction and smooth telescoping movement between said first and second tubular members.

12. A telescoping boat tower apparatus as set forth in claim 9, further comprising:

a combination travel limit and height lock plunger positioned between corresponding first and second tubular members whereby said upper frame assembly is prevented from excessive upward movement above a pre-determined upper in-use position thereto.

13. A telescoping boat tower apparatus attachable atop a deck structure of a boat comprising:

a lower frame assembly including a plurality of spaced upright elongated first tubular supports each attachable at a lower end thereof to the deck of a boat, an upper portion of each of said first tubular supports being connected to a perimeter of and including a standing platform positioned above a console and deck of the boat;

an upper frame assembly including said plurality of spaced upright elongated second tubular supports each connected at an upper end thereof to a body support rail and held in overlapping telescoping coaxial alignment and registry with corresponding said first tubular members whereby said upper frame assembly is movable vertically with respect to said lower frame assembly by telescopic movement between said plurality of first and second tubular supports;

an elongated sealed interior volume defined within at least one said second tubular support;

a source of pressurized fluid introducible into said sealed interior chamber whereby said upper frame assembly is vertically movable with respect to said lower frame assembly responsive to controlled variation of the fluid pressure and volume of fluid in said sealed interior chamber between a lowered temporary position and an elevated in-use position of said upper frame assembly.

14. A telescoping boat tower apparatus as set forth in claim 13, further comprising:

centering guide members positioned between corresponding said first and second tubular members for reduced friction and smooth telescoping movement between said first and second tubular members.

15. A telescoping boat tower apparatus as set forth in claim 13, further comprising:

a centering roller adjustably positioned between an upper portion of each of said first tubular members and corresponding said second tubular members for centering said second tubular member with respect to said first tubular member for reduced friction and smooth telescoping movement between said first and second tubular members.

16. A telescoping boat tower apparatus as set forth in claim 13, further comprising:

a combination travel limit and height lock plunger positioned between corresponding first and second tubular members whereby said upper frame assembly is prevented from excessive upward movement above a pre-determined upper in-use position thereto.

* * * * *